United States Patent [19]

Clevenhagen

[11] Patent Number: 4,853,975

[45] Date of Patent: Aug. 8, 1989

[54] CATCHER'S MITT

[75] Inventor: Robert L. Clevenhagen, Ava, Mo.

[73] Assignee: Figgie International Inc., Richmond, Va.

[21] Appl. No.: 180,084

[22] Filed: Apr. 11, 1988

[51] Int. Cl.[4] ..... A41D 13/08

[52] U.S. Cl. ..... 2/19; 2/DIG. 7

[58] Field of Search ..... 2/19, 161 A, DIG. 7

[56] References Cited

U.S. PATENT DOCUMENTS

| | | | |
|---|---|---|---|
| 3,588,917 | 6/1971 | Antonious | 2/161 A |
| 3,602,915 | 9/1971 | Collins | 2/19 |
| 4,346,481 | 8/1982 | Latina | 2/19 |
| 4,527,287 | 7/1985 | Aoki | 2/19 |
| 4,651,345 | 3/1987 | Latina | 2/19 |
| 4,701,963 | 10/1987 | Overton | 2/161 A |

*Primary Examiner*—Ronald Feldbaum

*Attorney, Agent, or Firm*—Senniger, Powers, Leavitt and Roedel

[57] ABSTRACT

A baseball catcher's mitt having front and back walls secured at the periphery of the mitt to form a mitt body. A back panel member is secured to the back wall of the mitt for substantially covering the back of the hand. The back panel member and body of the mitt having unconnected lower edge margins defining a hand opening at the bottom of the mitt through which the hand may be inserted up into the mitt between the back panel member and the back wall of the glove. A pair of laterally spaced slots extend up from the lower edge margin of the back panel member. These slots are expansible in width to enlarge the size of the hand opening and contractible in width to reduce the size of the hand opening. Independently operable quick-operating mechanisms are provided for adjusting the widths of the slots and for releasably maintaining the slots at their selected widths.

6 Claims, 4 Drawing Sheets

CATCHER'S MITT

BACKGROUND OF THE INVENTION

This invention relates generally to baseball equipment and, more particularly, to an improved catcher's mitt.

In a catcher's mitt it is important that the size of the hand opening be readily adjustable, not only to accommodate various hand shapes and sizes, but also to accommodate changes in the mitt as it is broken in and worn over a period of time. It is also essential that the catcher's mitt provide the necessary protection for the catcher's hand.

SUMMARY OF THE INVENTION

Among the several objects of this invention may be noted the provision of a catcher's mitt with an improved design for adjusting the size and shape of the hand opening; the provision of such a mitt wherein the finger side of the hand opening and the thumb side of the hand opening are independently adjustable, thereby enabling a better fit of the mitt on a player's hand; the provision of such a mitt which has extra padding for protecting the palm and which is relatively simple in design for economical manufacture.

Briefly, a catcher's mitt of this invention has front and back walls secured at the periphery of the mitt to form a mitt body, a back panel member secured to the back wall of the mitt for substantially covering the back of the hand and forming, in conjunction with the back wall of the mitt, finger stall means for receiving the fingers of the hand and a thumb stall for receiving the thumb of the hand. The back panel member and body of the mitt have unconnected lower edge margins defining a hand opening at the bottom of the mitt through which the hand may be inserted up into the mitt between the back panel member and the back wall of the glove. A first slot in the back panel member extends upwardly from the lower edge margin thereof toward said finger stall means, and a second slot in the back panel member is spaced laterally from the first slot in the direction toward the thumb side of the mitt and extends upwardly from the lower edge margin of the back panel member. The first and second slots are expansible in width to enlarge the size of the hand opening and contractible in width to reduce the size of the hand opening. First quick-operating means is provided for adjusting the width of the first slot to a selected width when the hand is in the mitt and for releasably maintaining the first slot at said selected width, and second quick-operating means is provided for adjusting the width of the second slot to a selected width when the hand is in the mitt and for releasably maintaining the second slot at said selected width. The first and second slots and respective quick-operating means are independently operable with respect to one another to adjust the size of the hand opening.

Other objects and features will be in part apparent and in part pointed out hereinafter.

BRIEF DESCRIPTION OF THE DRAWINGS

Corresponding reference numerals indicate corresponding parts throughout the several views of the drawings.

DESCRIPTION OF THE PREFERRED EMBODIMENT

Figure 1:
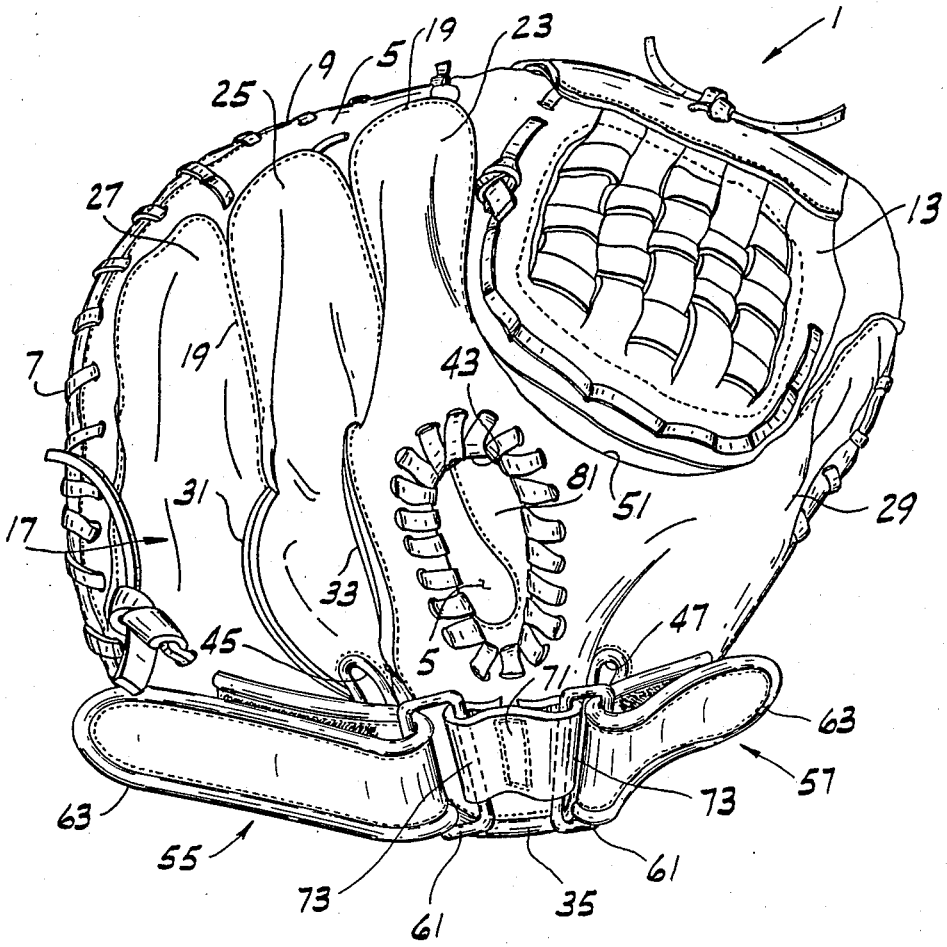
FIG. 1 is a rear view of a catcher's mitt of this invention.
Figure 2:
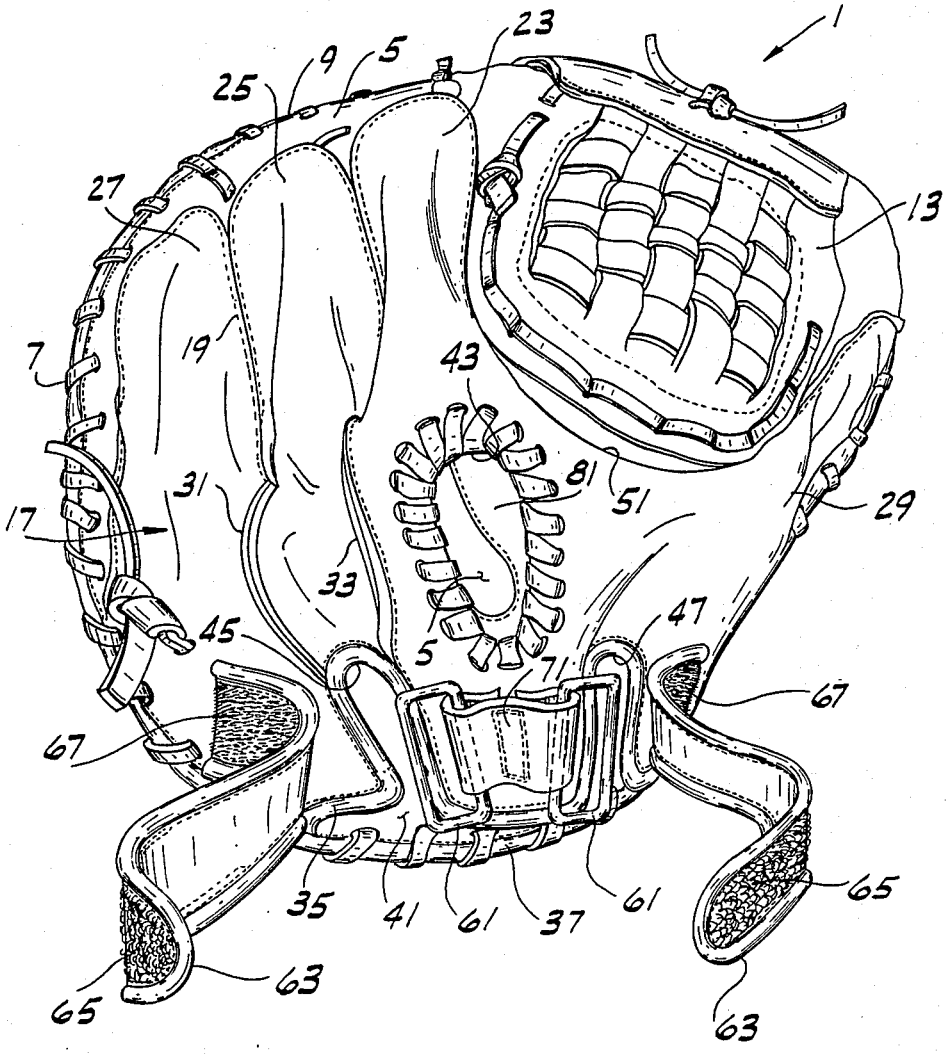
FIG. 2 is a view illustrating a feature for adjusting the size of the hand opening of the mitt.

Referring now to the drawings, a catcher's mitt having the features of this invention is designated in its entirety by the reference numeral 1. As shown, the mitt comprises front and back walls designated 3 and 5, respectively, of suitable sheet material (e.g., leather) secured at the periphery of the mitt by lacing 7 to form a generally circular mitt body 9. Suitable padding 11 is provided between the front and back walls of the mitt for protection of the hand, as will be known to those skilled in the art. A web 13 is attached to the mitt body in conventional fashion.

A back panel member generally designated 17 is secured, as by stitching 19, to the back wall 5 of the mitt for covering the back of the hand. This panel member is generally in the shape of a hand to form, in conjunction with the back wall of the mitt, finger stall means comprising a plurality of finger stalls 23, 25 and 27 for receiving the fingers of the hand, and a thumb stall 29 for receiving the thumb. It will be understood that while the panel member 17 shown in the drawings is configured to form three separate finger stalls, this number may vary from one to four finger stalls (hence the use of the term "finger stall means"). The back panel member 17 is of flexible sheet material, such as leather, and may comprise a plurality of pieces sewn together along seams indicated at 31 and 33. The back panel member 17 and the body 9 of the mitt have unconnected lower edge margins designated 35 and 37, respectively, defining a hand opening 41 at the bottom of the mitt through which the hand may be inserted up into the mitt between the back panel member and the back wall 17, with the fingers being received in the finger stalls 23, 25 and 27 and the thumb in the thumb stall 29.

The back panel member 17 has an opening 43 therein sized for comfortably accommodating only one finger, that being the index finger, the position of the opening being such that, with the hand in the mitt, the index finger may be inserted through the opening to extend up on the outside of the back panel member, if a player should desire to do so.

In accordance with one aspect of this invention, the back panel member 17 has two slots therein indicated at 45 and 47. The first slot 45 extends up from the lower edge margin 35 of the back panel member generally toward the middle finger stall 25 immediately to the left of opening 43. The second slot 47 is spaced laterally from the first slot 45 in the direction toward the thumb side of the mitt and extends up from the lower edge margin 35 of the back panel member generally toward the crotch 51 of the back panel member 17 on the right side of opening 43 (the opening 43 thus being positioned between the two slots 45, 47). Given the flexible nature of the back panel member, the slots 45 and 47 are expansible in width, which serves to enlarge the size of the hand opening 41, and contractible in width, which serves to reduce the size of the hand opening, thereby providing adjustment of the hand opening to fit the size and shape of the hand of the particular player wearing the mitt.

Indicated generally at 55 and 57 in FIG. 1 are first and second quick-operating means adapted for adjusting the width of slots 45 and 47, respectively, when a player's hand is in the mitt, and for releasably maintaining the slots at their selected widths. Each of these means comprises a buckle 61 secured to the back panel member 17 of the mitt at one side of a respective slot, and a strap 63 secured at one end on an opposite side of the respective slot. The strap has releasably interengageable connector components (e.g., Velcro patches 65, 67) thereon, one component 65 being adjacent the outer free end of the strap on one face of the strap and the other component 67 being adjacent the inner end of the strap on the same face. The arrangement is such that the free end of each strap is adapted to be inserted through a respective buckle 61, doubled back on itself, and pulled to adjust the width of the respective slot so that the mitt fits on the hand. The connector components 65, 57 on the strap are then brought into engagement, as shown in FIG. 1, to maintain each slot at the desired width and the hand opening 41 at the desired size. The buckles 61 are held by a single strip 71 of flexible material (e.g., leather) secured as by stitching to the back panel member between the slots 45, 47 below the finger opening 43. The ends of the strip 71 are folded to form two loops, each designated 73, which hold the buckles 61. It will be understood that other quick-operating means may be used in lieu of means 55 and 57.

The above construction is advantageous in that each quick-operating means 55, 57 is independently operable with respect to the other to adjust the size of the opening, thereby enabling a player a greater range of adjustment to suit his or her own particular needs. For example, if a player wants the thumb side of the glove to be relatively loose (on account of a thumb injury, for example) but the finger side of the glove to be tight, this can be readily accomplished by appropriately adjusting respective quick-operating means 55 and 57. It is preferable that the index finger be placed through opening 43 prior to any adjustment. This tends to stabilize the center of the mitt so that adjustment of one side of the mitt does not substantially effect the fit of the mitt on the other side.

Figure 3:
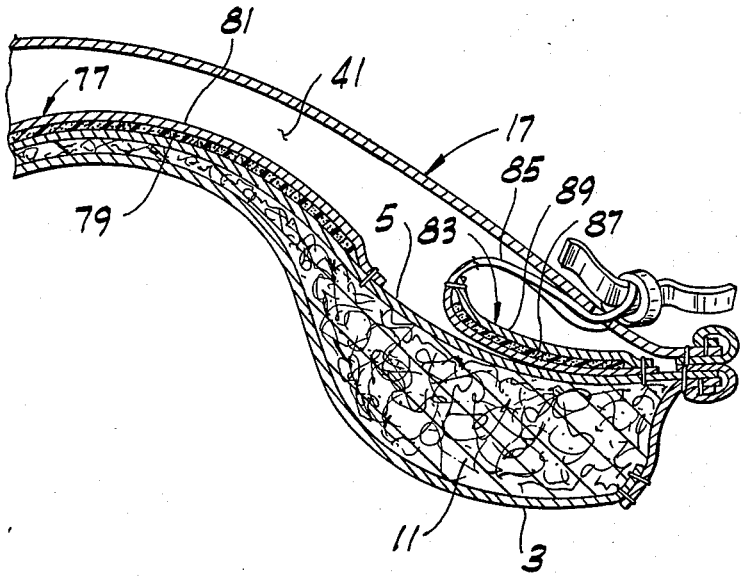
FIG. 3 is an enlarged section taken on line 3—3 of FIG. 1 showing palm and thumb padding in the mitt.
Figure 4:
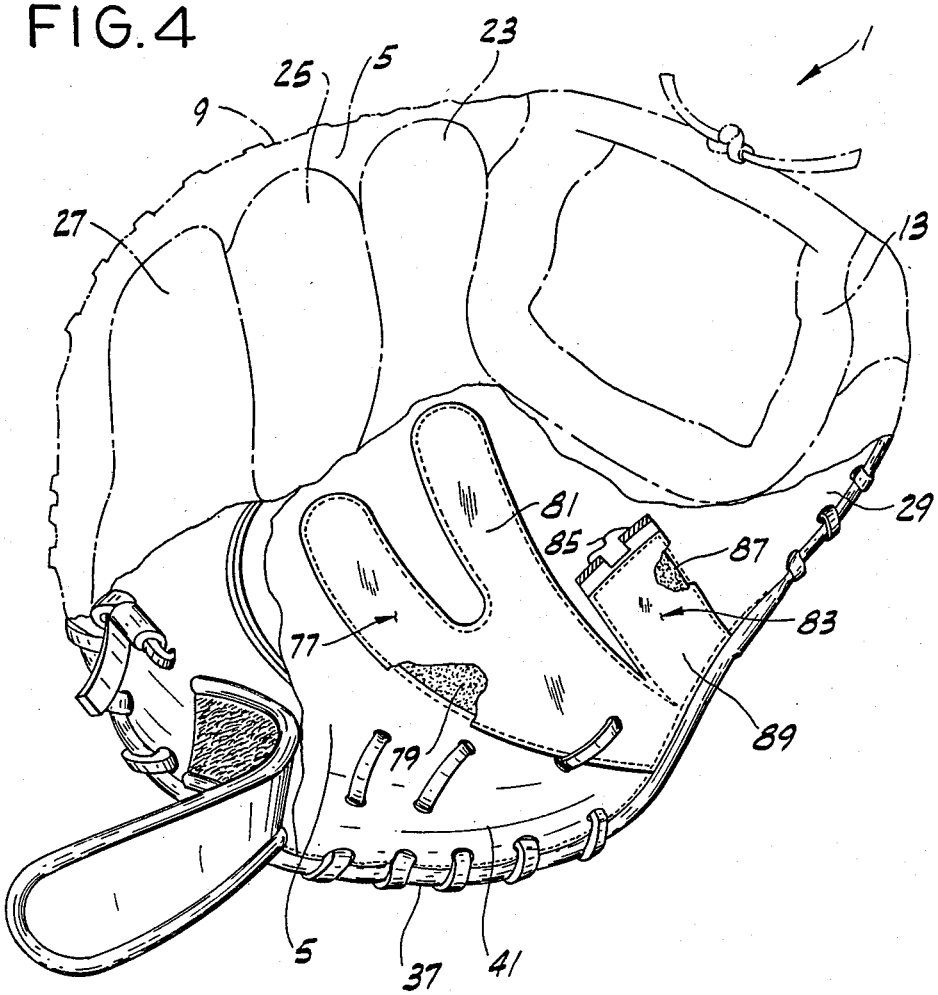
FIG. 4 is a view similar to FIG. 1 with portions of the back of the mitt broken away to show a palm pad and a thumb pad.

Another aspect of the present invention is best illustrated in FIGS. 3 and 4 which show certain padding of the present invention for providing additional protection to the catcher's hand in the area of the palm and thumb. This padding includes a palm pad, generally designated 77, comprising padding 79 on the outside surface of the back wall 5 of the mitt, and a cover 81 over the padding stitched at its periphery to the back wall 5. A thumb pad, generally designated 83, is also provided on the inside of a thumb loop 85 located at the base of the thumb stall 29. This thumb pad 83 is preferably an extension of the palm pad (although not necessarily so) and comprises padding 87 on the inside surface of the loop and a cover 89 over the padding stitched to the loop.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A baseball catcher's mitt having front and back walls secured at the periphery of the mitt to form a mitt body, a back panel member secured to the back wall of the mitt for substantially covering the back of the hand and forming, in conjunction with the back wall of the mitt, finger stall means for receiving the fingers of the hand and a thumb stall for receiving the thumb of the hand, said back panel member and body of the mitt having unconnected lower edge margins defining a hand opening at the bottom of the mitt through which the hand may be inserted up into the mitt between the back panel member and the back wall of the glove, a first slot in the back panel member extending upwardly from the lower edge margin thereof toward said finger stall means, a second slot in the back panel member spaced laterally from the first slot in the direction toward the thumb side of the mitt and extending upwardly from the lower edge margin of the back panel member, said first and second slots being expansible in width to enlarge the size of the hand opening and contractible in width to reduce the size of the hand opening, first quick-operating means adapted for adjusting the width of the first slot to a selected width when the hand is in the mitt and for releasably maintaining the first slot at said selected width, and second quick-operating metals adapted for adjusting the width of the second slot to a selected width when the hand is in the mitt and for releasably maintaining the second slot at said selected width, said first and second slots and respective quick-operating means being independently operable with respect to one another to adjust the size of the hand opening.

2. A catcher's mitt as set forth in claim 1 wherein said back panel member has an opening therein sized for comfortably accommodating only one finger whereby a finger may be inserted through the opening to extend up on the outside of the back panel member, said finger opening being spaced above the hand opening in an area located generally between said first and second slots.

3. A catcher's mitt as set forth in claim 1 wherein each of said first and second quick-operating means comprises a buckle secured to the back panel member of the mitt at one side of a respective slot, and a strap having releasably interengageable connector components thereon secured to the back panel member on an opposite side of the respective slot, said strap having a free end adapted to be inserted through said buckle and then doubled back to bring said connector components into interengagement.

4. A catcher's mitt as set forth in claim 3 further comprising a single strip of flexible material secured to the back panel member between said slots and folded to form two loops for holding the buckles of said first and second quick-operating means.

5. A catcher's mitt as set forth in claim 1 further comprising a thumb loop attached to the back wall of the mitt in said thumb stall, and a pad in said thumb loop.

6. A catcher's mitt as set forth in claim 5 further comprising a palm pad attached to the back wall of said mitt for padding the palm of the hand, said thumb loop pad comprising an extension of said palm pad.

* * * * *

UNITED STATES PATENT AND TRADEMARK OFFICE

CERTIFICATE OF CORRECTION

PATENT NO. : 4,853,975

DATED : August 8, 1989

INVENTOR(S) : Robert L. Clevenhagen

It is certified that error appears in the above-identified patent and that said Letters Patent is hereby corrected as shown below:

Column 4, Line 30, "quick operating metals adapted" should read --"quick-operating means adapted".

Signed and Sealed this

Twentieth Day of November, 1990

*Attest:*

HARRY F. MANBECK, JR.

*Attesting Officer*

*Commissioner of Patents and Trademarks*